US011702181B2

(12) United States Patent
Ziegel et al.

(10) Patent No.: US 11,702,181 B2
(45) Date of Patent: Jul. 18, 2023

(54) IN-DAVIT RUN KITS AND METHODS FOR LIFEBOATS

(71) Applicant: Survival Systems International, Inc., Valley Center, CA (US)

(72) Inventors: James Ziegel, Valley Center, CA (US); Kyle Seaman, Valley Center, CA (US); Juan Barrientos, Valley Center, CA (US); Roger Lopez, Valley Center, CA (US)

(73) Assignee: Survival Systems International, Inc., Valley Center, CA (US)

( * ) Notice: Subject to any disclaimer, the term of this patent is extended or adjusted under 35 U.S.C. 154(b) by 224 days.

(21) Appl. No.: 17/132,545

(22) Filed: Dec. 23, 2020

(65) Prior Publication Data

US 2022/0194543 A1 Jun. 23, 2022

(51) Int. Cl.
*F01P 5/10* (2006.01)
*B63H 21/38* (2006.01)
(Continued)

(52) U.S. Cl.
CPC ..... *B63H 21/383* (2013.01); *B63H 1/14* (2013.01); *B63H 21/14* (2013.01); *B63H 21/21* (2013.01); *B63H 23/00* (2013.01); *B63H 25/00* (2013.01); *F01N 3/04* (2013.01); *F01N 13/004* (2013.01); *F01P 3/207* (2013.01); *F01P 5/10* (2013.01);
(Continued)

(58) Field of Classification Search
CPC ..... B63H 21/383; B63H 21/10; B63H 21/14; B63H 1/14; B63H 21/24; B63H 21/38; B63J 2/12; F01N 13/004; F01P 7/00; F01P 7/14; F01P 2007/146; F01P 2050/02; F01P 2050/04; F01P 2050/06; F01P 2050/12;
(Continued)

(56) References Cited

U.S. PATENT DOCUMENTS 4,413,583 A 11/1983 Elling et al.
4,789,367 A * 12/1988 Fulks ..... B63B 13/00 440/88 N
(Continued)

FOREIGN PATENT DOCUMENTS

CN 2910274 Y * 6/2007
CN 105464783 A * 4/2016 ..... F01P 11/00
(Continued)

OTHER PUBLICATIONS

International Search Report and Written Opinion in PCT/US2021/064989, dated Mar. 18, 2022.
(Continued)

*Primary Examiner* — George C Jin
*Assistant Examiner* — Teuta B Holbrook
(74) *Attorney, Agent, or Firm* — Sheppard Mullin Richter & Hampton LLP

(57) ABSTRACT

In general, one aspect disclosed features an in-davit run kit for a lifeboat, the kit comprising: a water container comprising a first connector; a hose configured to connect with the first connector; and a second connector configured to connect to the hose, wherein the second connector is in fluid communication with a water cooling system of the lifeboat; wherein the in-davit run kit allows a water pump of the lifeboat to draw water from the water container into the water cooling system of the lifeboat.

15 Claims, 14 Drawing Sheets

(51) Int. Cl.

| | |
|---|---|
| ***B63H 21/14*** | (2006.01) |
| ***B63H 23/00*** | (2006.01) |
| ***B63H 1/14*** | (2006.01) |
| ***B63H 25/00*** | (2006.01) |
| ***F01N 3/04*** | (2006.01) |
| ***F01P 7/14*** | (2006.01) |
| ***F01P 11/02*** | (2006.01) |
| ***B63H 21/21*** | (2006.01) |
| ***F01P 3/20*** | (2006.01) |
| ***F01N 13/00*** | (2010.01) |

(52) U.S. Cl.
CPC ..... *F01P 7/14* (2013.01); *F01P 11/0204* (2013.01); *F01N 2260/024* (2013.01); *F01P 2007/146* (2013.01)

(58) Field of Classification Search
CPC .. F01P 11/06; F01P 3/202; F01P 3/205; F01P 11/0204; F01P 5/10
See application file for complete search history.

(56) References Cited

U.S. PATENT DOCUMENTS

| | | | | |
|---|---|---|---|---|
| 5,333,752 | A | 8/1994 | Hardng, Jr. et al. | |
| 6,379,201 | B1 * | 4/2002 | Biggs | F02B 61/04 440/88 N |
| 6,695,660 | B1 * | 2/2004 | Ellis | B63H 21/12 440/88 C |
| 10,919,607 | B1 * | 2/2021 | Jankowski | A62C 3/10 |
| 2003/0104333 | A1 * | 6/2003 | Sendzik | B63J 2/14 432/122 |
| 2003/0114053 | A1 * | 6/2003 | Hahn | B63H 21/10 440/88 N |
| 2006/0289571 | A1 * | 12/2006 | Saxman | F01P 11/06 222/630 |
| 2007/0084512 | A1 * | 4/2007 | Tegge | B63B 13/02 137/487.5 |
| 2007/0240434 | A1 * | 10/2007 | Allen | F01P 11/16 62/129 |
| 2009/0269998 | A1 * | 10/2009 | Berti | F01P 3/205 440/88 N |
| 2009/0294486 | A1 | 12/2009 | Mcknight et al. | |
| 2011/0275258 | A1 * | 11/2011 | Hamlin | B63J 3/04 440/88 N |
| 2012/0009831 | A1 * | 1/2012 | Howard | B63H 21/38 440/88 N |
| 2014/0179180 | A1 * | 6/2014 | Hanstrom | B63H 21/383 440/88 N |

FOREIGN PATENT DOCUMENTS

| | | | | |
|---|---|---|---|---|
| CN | 208085427 | U * | 11/2018 | |
| EP | 1847694 | A2 * | 10/2007 | F01P 11/16 |
| KR | 20070073603 | A * | 7/2007 | |
| SE | 465422 | B | 9/1991 | |
| WO | 2020054939 | A1 | 3/2020 | |

OTHER PUBLICATIONS

"Engine Run Kit" (Survival Systems International) Dec. 2, 2020 (URL: https://web.archive.org/web/20201202121142/https./www.survivalsystemsinternational.com/wp-content/uploads/2020/08/Engine-Run-Kit-new.pdf.>, entire document.

* cited by examiner

IN-DAVIT RUN KITS AND METHODS FOR LIFEBOATS

BACKGROUND

The disclosed technologies relates generally to lifeboats, and more particularly some embodiments relate to cooling systems for lifeboats.

SUMMARY

In general, one aspect disclosed features an in-davit run kit for a lifeboat, the kit comprising: a water container comprising a first connector; a hose configured to connect with the first connector; and a second connector configured to connect to the hose, wherein the second connector is in fluid communication with a water cooling system of the lifeboat; wherein the in-davit run kit allows a water pump of the lifeboat to draw water from the water container into the water cooling system of the lifeboat.

Embodiments of the kit may include one or more of the following features. Some embodiments comprise a valve disposed between the second connector and the water cooling system of the lifeboat. Some embodiments comprise a heat exchanger in fluid communication with an engine of the lifeboat, and in thermal communication with the water cooling system of the lifeboat. Some embodiments comprise a propeller shaft bearing in fluid communication with the water cooling system of the lifeboat. Some embodiments comprise a valve disposed between the water container and the first connector. In some embodiments, the water container comprises an inlet configured to receive a supply hose to provide the water container with water. In some embodiments, the water container comprises a vent configured to discharge excess water.

In general, one aspect disclosed features a lifeboat comprising: a water cooling system; a connector configured to connect to a hose, wherein the connector is in fluid communication with a water cooling system of the lifeboat; and a water pump configured to draw water through the hose into the water cooling system of the lifeboat.

Embodiments of the lifeboat may include one or more of the following features. Some embodiments comprise a valve disposed between the first connector and the water cooling system of the lifeboat. Some embodiments comprise an engine; and a heat exchanger in fluid communication with the engine of the lifeboat, and in thermal communication with the water cooling system of the lifeboat. Some embodiments comprise a propeller shaft bearing in fluid communication with the water cooling system of the lifeboat. Some embodiments comprise a sprinkler system in fluid communication with the water cooling system of the lifeboat. Some embodiments comprise a valve disposed between the sprinkler system and the water cooling system of the lifeboat. Some embodiments comprise a water container comprising a second connector; and the hose, wherein the hose is configured to connect with the second connector. Some embodiments comprise a valve disposed between the water container and the second connector. In some embodiments, the water container comprises at least one of: an inlet configured to receive a water hose to fill the water container with water; and a vent configured to discharge excess water.

In general, one aspect disclosed features a method comprising: connecting a water container to a water cooling system of a lifeboat; adding water to the water container; and starting an engine, and a water pump, of the lifeboat, wherein the water pump draws water from the water container into the water cooling system of a lifeboat.

Embodiments of the method may include one or more of the following features. Some embodiments comprise opening a valve disposed between the water container and the water cooling system of the lifeboat. Some embodiments comprise closing a seawater intake valve of the water cooling system of the lifeboat prior to starting the engine and the water pump of the lifeboat. Some embodiments comprise, after starting the engine and the water pump, testing at least one of: general start and operation of the lifeboat; function of the engine of the lifeboat and a transmission of the lifeboat; a sprinkler system of the lifeboat; propeller and steering operations of the lifeboat; or a water-cooled exhaust system of the lifeboat.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1:
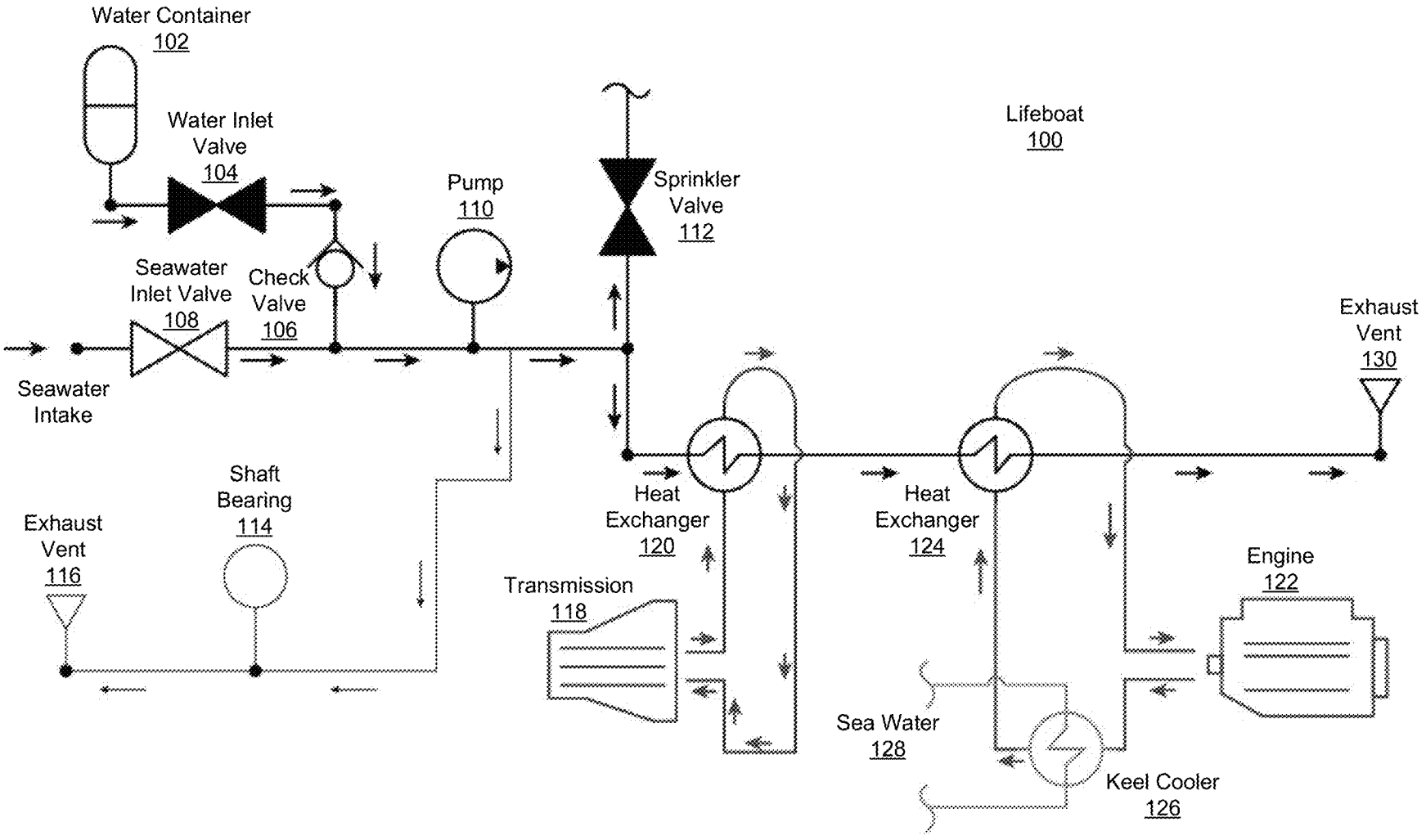
FIG. 1 is a block diagram of components of a lifeboat that includes an in-davit run kit according to some embodiments of the disclosed technologies.

The figures are not exhaustive and do not limit the present disclosure to the precise form disclosed.

DETAILED DESCRIPTION

Embodiments of the disclosed technologies relate to lifeboats, for example such as Totally Enclosed Motor Propelled Survival Craft type lifeboats. These lifeboats may be located on offshore oil and gas facilities, on ships such as cargo and cruise ships, and the like. In this disclosure, the terms "water" and "seawater" are used interchangeably. In the disclosed technology, water of any typical salinity may be used, including fresh, saline, and brackish water.

Lifeboats are critical safety devices, and require regular maintenance and system operation to help ensure their "ready-to-launch" status. Like many other boats, conventional lifeboats require water to cool the engine and other parts, and therefore must be in the water in order to operate for any extended time. Lifeboats often require water for other purposes as well. For example, lifeboats are often equipped with external sprinkler systems to distribute a cover of water over the lifeboat to help facilitate evacuation during fires or extreme heat.

There is a need to test lifeboat systems often to ensure they will operate properly in the event the lifeboat is needed. Because they require water for cooling, lifeboats are conventionally tested by launching the lifeboat, testing the lifeboat in the water, and then retrieving the lifeboat and storing the lifeboat in its davit.

However, there is a fear associated with launching lifeboats because it can be a difficult and dangerous process. For example, most lifeboats are traditional "twin-fall lifeboats," which are long and narrow, and incorporate two hooks—one in the front of the boat and one in the aft. There is much difficulty associated with having to attach and dis-attach from the two hooks. There are also several safety concerns, including the need to ensure both hooks are correctly attached before hoisting the lifeboat. Additionally, conventional lifeboat hooks are biased to open, and have stops and locks to prevent opening. These locks/stops have a special valve "sensor" (e.g., a hydrostatic valve) that unlocks the locks upon detecting the lifeboat is in the water. However, there is a risk that if these locks/stops malfunction, or if the hydrostatic valve malfunctions, a nervous lifeboat captain could accidently open the hooks and drop the lifeboat. Because lifeboats are usually stowed far above the water on an oil and gas platform, dropping a lifeboat full of people would be devastating. These fears associated with launching lifeboats often prevent regular testing, maintenance, and inspection.

To address these problems, embodiments of the disclosed technologies provide in-davit run kits and methods for lifeboats, as well as lifeboats having the in-davit run kits installed. These kits, methods, and lifeboats allow the operation and testing of lifeboats while stowed in-davit, without having to launch the lifeboat.

According to some embodiments, the in-davit run kit contains a uniquely-designed water inlet assembly, hoses, and valves to be installed into a lifeboat. The kit also includes a portable water container for connection to the water inlet assembly using a hose. After installation of these components, the kit can accept incoming water from the portable water container for use in cooling the engine and other lifeboat components, operating an external sprinkler system of the lifeboat, and the like.

FIG. 1 is a block diagram of components of a lifeboat 100 that includes an in-davit run kit according to some embodiments of the disclosed technologies. Referring to FIG. 1, the elements of the in-davit run kit may include a water container 102. In some embodiments, the water container may be a portable, flexible container. For example, the water container may be a large bag of water capable of containing 150-250 gallons of water. The water container serves as a buffer in the water supply, allowing the lifeboat water pump to draw the water instead of forcing the water into the lifeboat.

The in-davit run kit may include one or both of a water inlet valve 104 and a check valve 106. The water inlet valve 104 may be manually operated. The water inlet valve 104 may be opened to admit water from the water container 102, and may be closed when the water container 102 is not connected. The check valve 106 may be configured to prevent water from exiting the lifeboat through the water inlet.

When the lifeboat 100 has been launched, and is operating in the water, the seawater inlet valve 108 may be opened to admit seawater into the water cooling system of the lifeboat 100. But for in-davit operations, the seawater inlet valve 108 may be closed. Instead, water is supplied from the water container 102. The water is drawn into the water cooling system by the water pump 110 of the lifeboat 100. The water is supplied to a heat exchanger 120 for cooling the transmission 118 of the lifeboat 100.

Some lifeboats rely only on seawater for cooling the engine. For example, lifeboat 100 includes a keel cooler 126 that uses seawater 128 to cool the engine 122 of the lifeboat 100. For this type of lifeboat, the in-davit run kit may include a heat exchanger 124 to cool the engine using the internal water cooling system. The heat exchanger 124 is installed in the lifeboat to be in fluid communication with the engine of the lifeboat, and in thermal communication with the water cooling system of the lifeboat. The water provided to the transmission heat exchanger 120, and the engine heat exchanger 124 if used, may exit the lifeboat 100 through an exhaust vent 130.

In some embodiments, the propeller shaft bearing 114 is also cooled by the water cooling system. In these embodiments, the water pump 110 may provide the water to the shaft bearing 114. The water may then exit the lifeboat through an exhaust vent 116.

As noted above, some lifeboats include an external sprinkler system. In these embodiments, the water pump 110 provides the water to the external sprinkler system. The lifeboat 100 may include a sprinkler valve 112. The sprinkler valve 112 may be manually operated. The sprinkler valve 112 may be opened to provide water to the external sprinkler system, or closed to prevent water from reaching the external sprinkler system, for example when the external sprinkler system is not needed.

In some embodiments, the in-davit run kit may include multiple water containers 102. For example the kit may include one water container for connection to the port side of the lifeboat, and a second water container for connection to the starboard side of the lifeboat. In these embodiments, the kit includes hoses and connectors for connecting each water container to the lifeboat. These embodiments serve lifeboats having more than one water pump.

Figure 2:
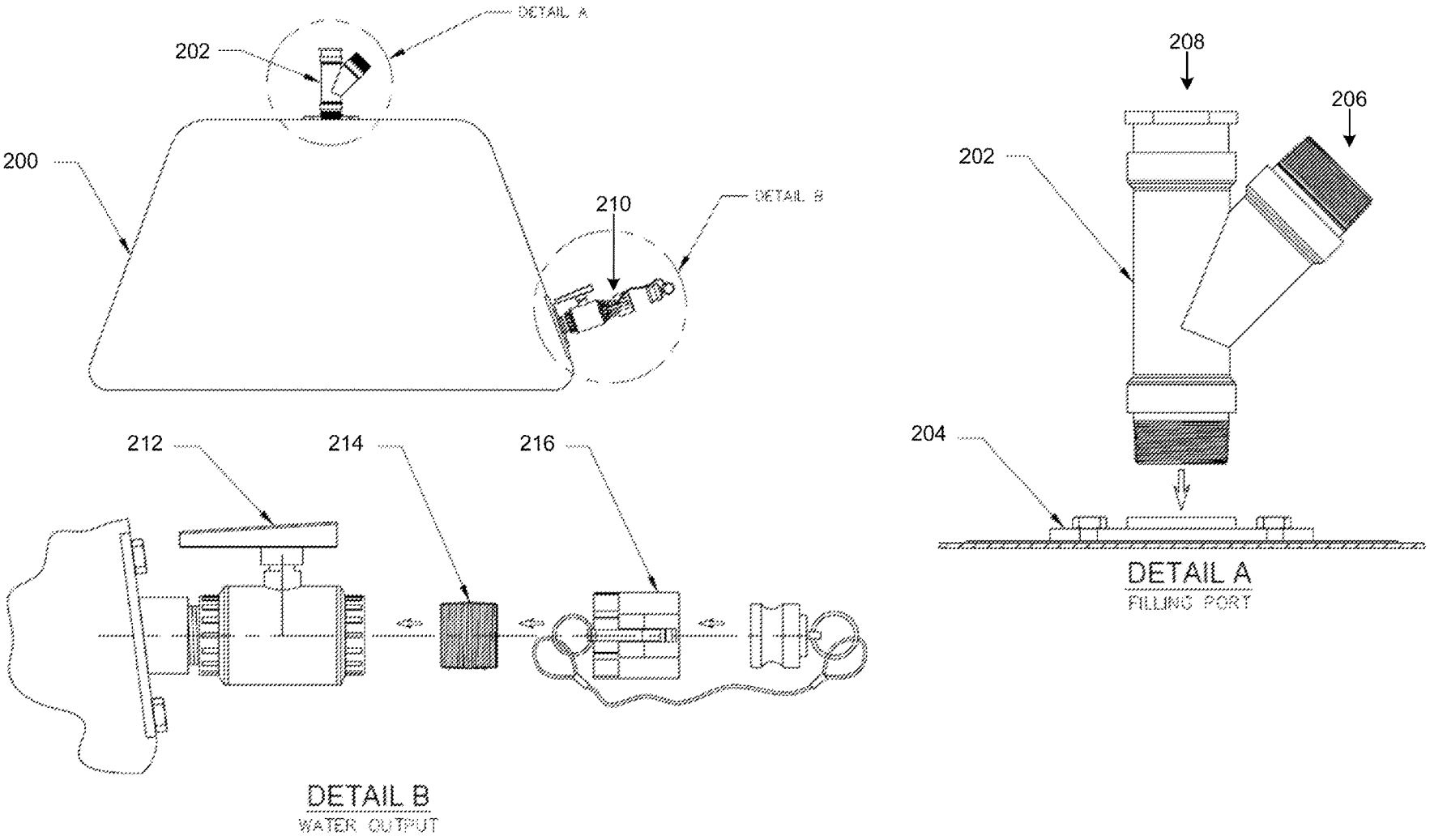
FIG. 2 provides schematic diagrams of a water container according to some embodiments of the disclosed technologies.

FIG. 2 provides schematic diagrams of a water container 200 according to some embodiments of the disclosed technologies. Referring to FIG. 2, the water container 200 may include an inlet assembly 202. The inlet assembly 202 may be attached to a filling port 204 of the water container 200. For example, both the inlet assembly 202 and the filling port 204 may be threaded, and the inlet assembly 202 may be attached to the filling port 204 by engaging the threads. The inlet assembly 202 may include an opening 206 to receive a hose for filling water container 200. The inlet assembly 202 may include a vent 208 to allow excess water to escape the water container 200. The water container 200 may be made of plastic, flexible plastic, and the like, In some embodiments, the water container 200 may be made of thermoplastic polyurethane (TPU).

The water container 200 may include an outlet assembly 210. The outlet assembly 210 may include an outlet valve 212. The outlet valve 212 may be manually operated to permit or prevent water from leaving the water container through the outlet assembly 210. The outlet assembly 210 may include a cam and groove assembly 216, and a threaded nipple 214 for connecting the cam and groove assembly to the outlet valve 212. However, any connector may be used in the outlet assembly 210.

Figure 3:
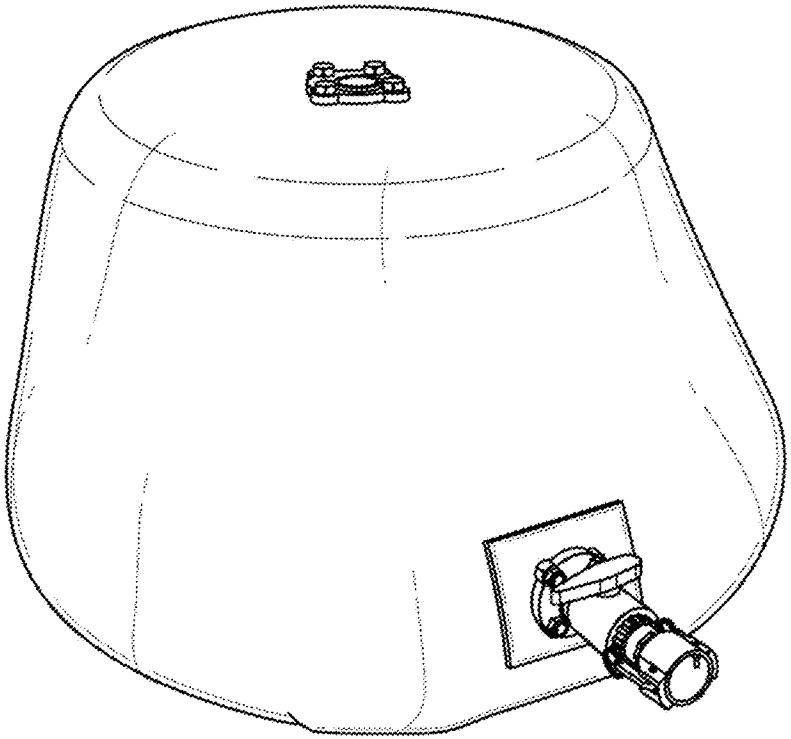
FIG. 3 illustrates a water container with an outlet assembly according to some embodiments of the disclosed technologies.

FIG. 3 illustrates a water container with an outlet assembly according to some embodiments of the disclosed technologies.

Figure 4:
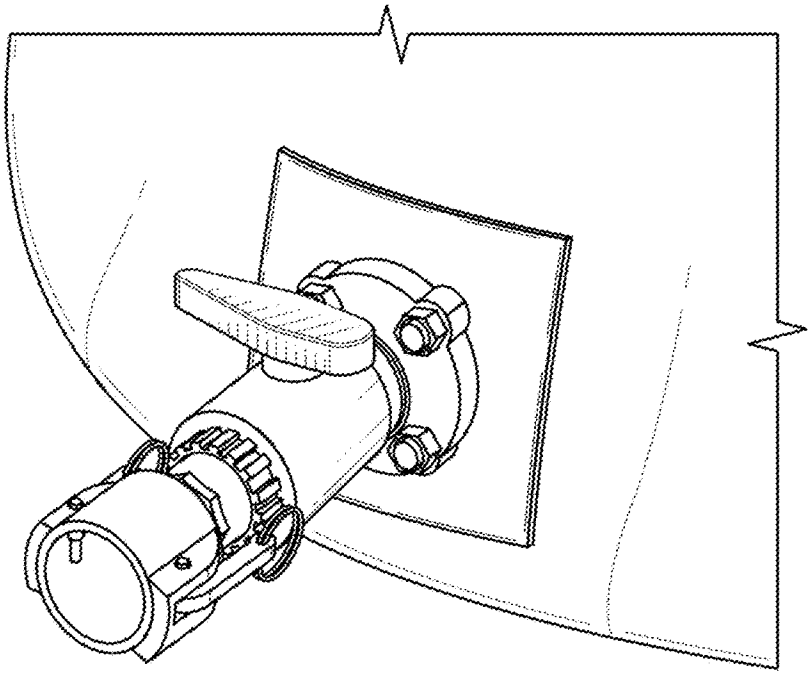
FIG. 4 illustrates the outlet assembly according to some embodiments of the disclosed technologies.

FIG. 4 illustrates an outlet assembly of the water container according to some embodiments of the disclosed technologies.

Figure 5:
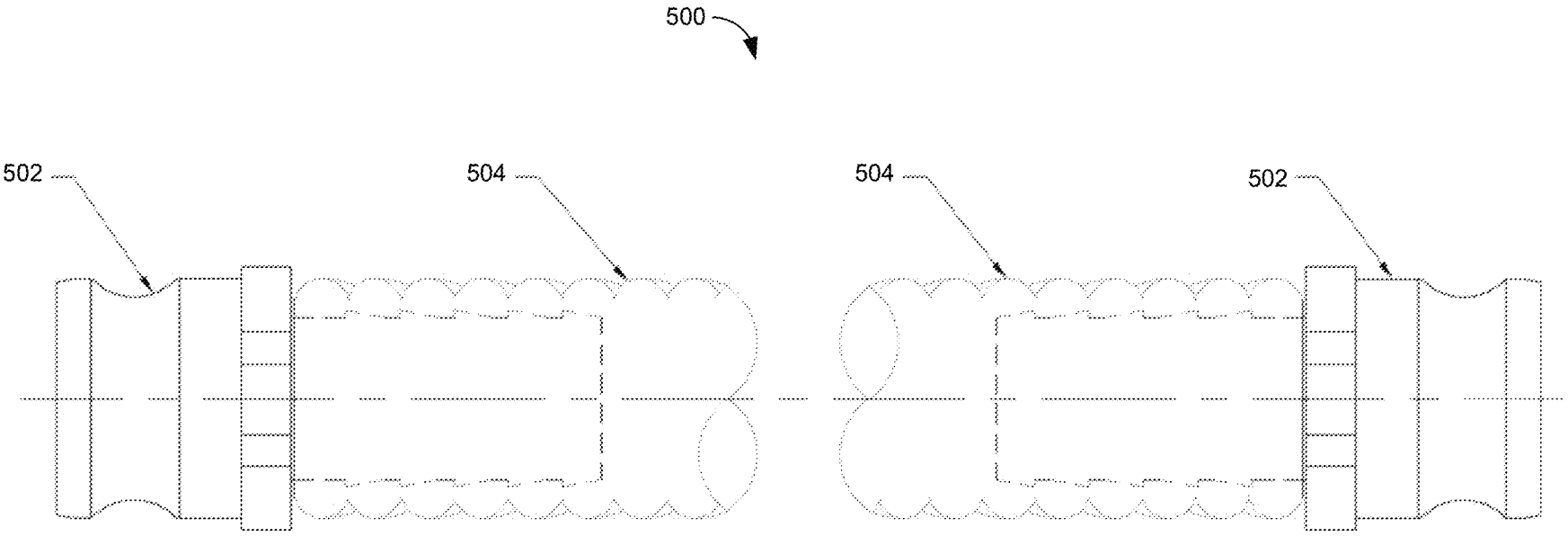
FIG. 5 is a schematic diagram of a hose assembly for connecting a water container to a lifeboat according to embodiments of the disclosed technologies.

FIG. 5 is a schematic diagram of a hose assembly 500 for connecting a water container to a lifeboat according to embodiments of the disclosed technologies. Referring to FIG. 5, the hose assembly 500 may include a hose 504. In some embodiments, the hose may have a diameter of 2 inches. The hose assembly 500 may also include cam and groove connectors 502 at each end of the hose 504. In other embodiments, any connector may be used in the hose assembly 500.

Figure 6:
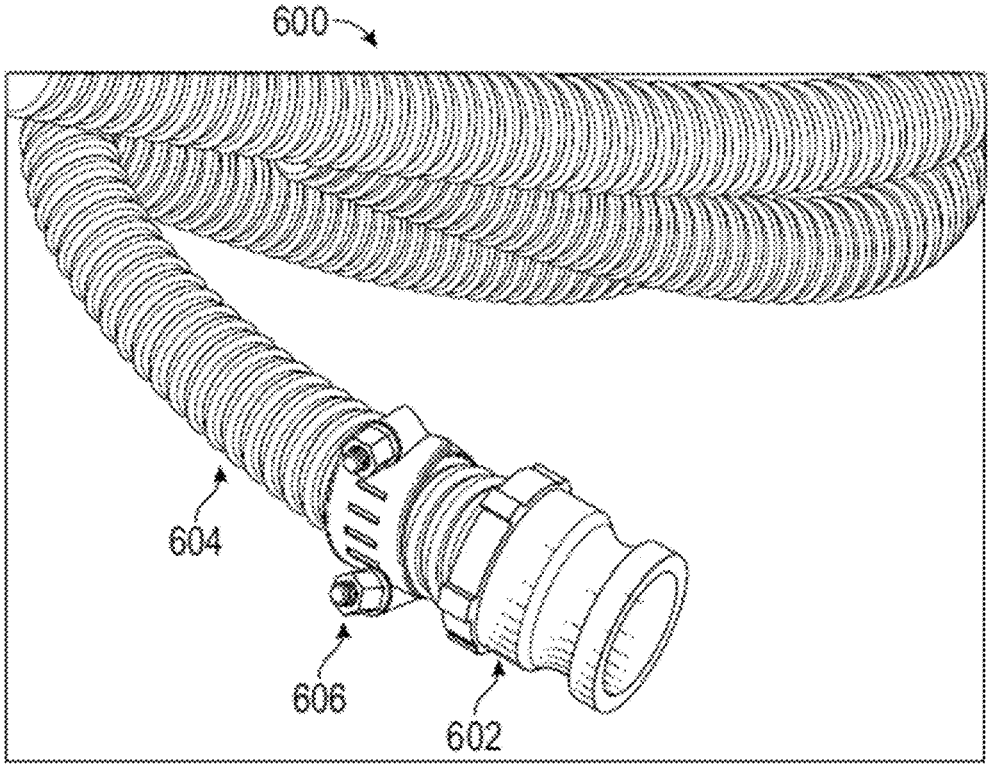
FIG. 6 illustrates a portion of a hose assembly according to some embodiments of the disclosed technologies.

FIG. 6 illustrates a portion of a hose assembly 600 according to some embodiments of the disclosed technologies. In the photograph of FIG. 6, a cam and groove connector 602 is secured to a hose 604 by a hose clamp 606. However, any connectors and means of securing the connectors to the hose may be used.

Figure 7:
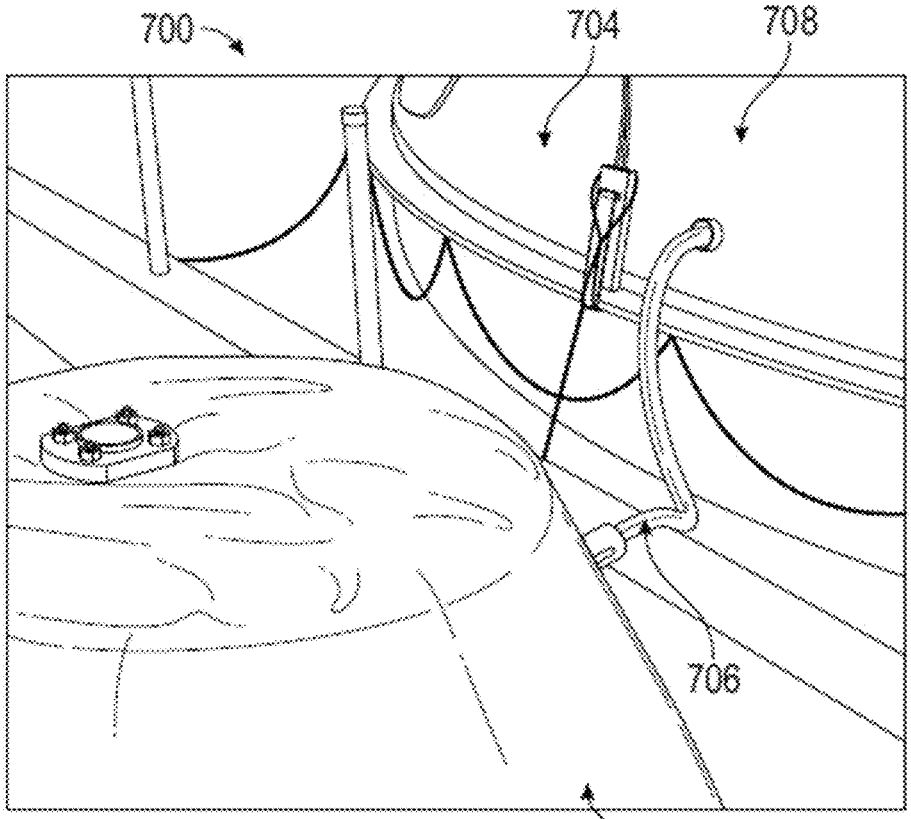
FIG. 7 illustrates a water container connected to a lifeboat by a hose assembly according to some embodiments of the disclosed technologies.

FIG. 7 illustrates a water container 702 connected to a lifeboat 704 by a hose assembly 706 according to some embodiments of the disclosed technologies. In the photograph of FIG. 7, the hose enters the lifeboat through a bilge port 708 of the lifeboat 704. However, the hose may enter the lifeboat in other ways.

Figure 8:
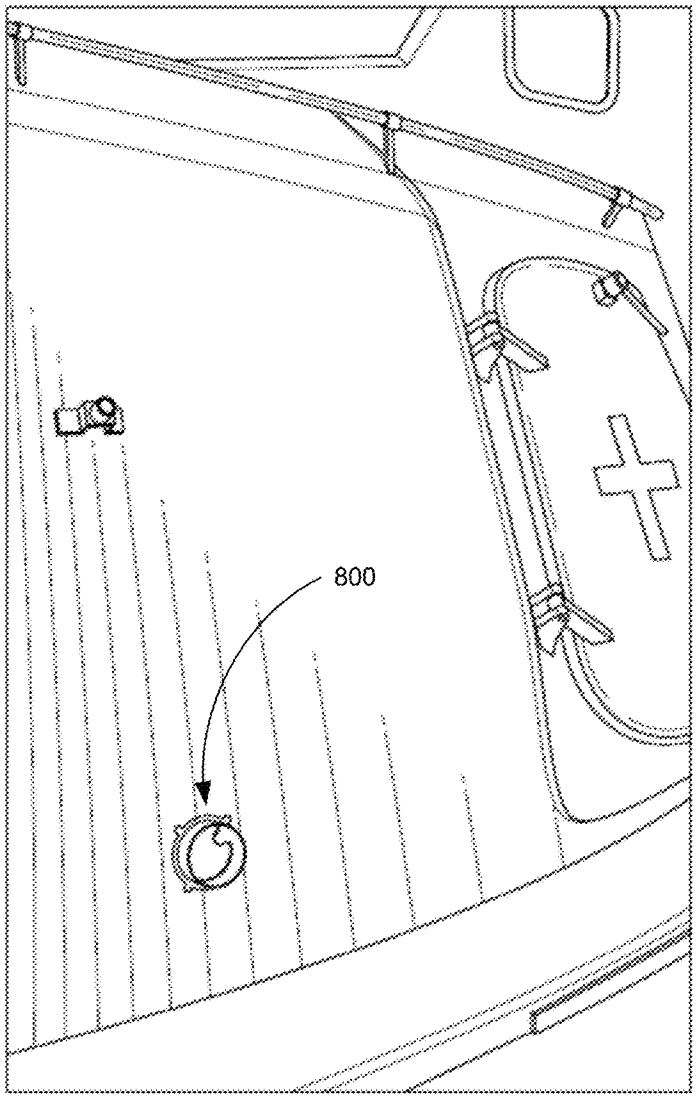
FIG. 8 is an exterior view of a lifeboat bilge port.

FIG. 8 is an exterior view of a lifeboat bilge port 800.

Figure 9:
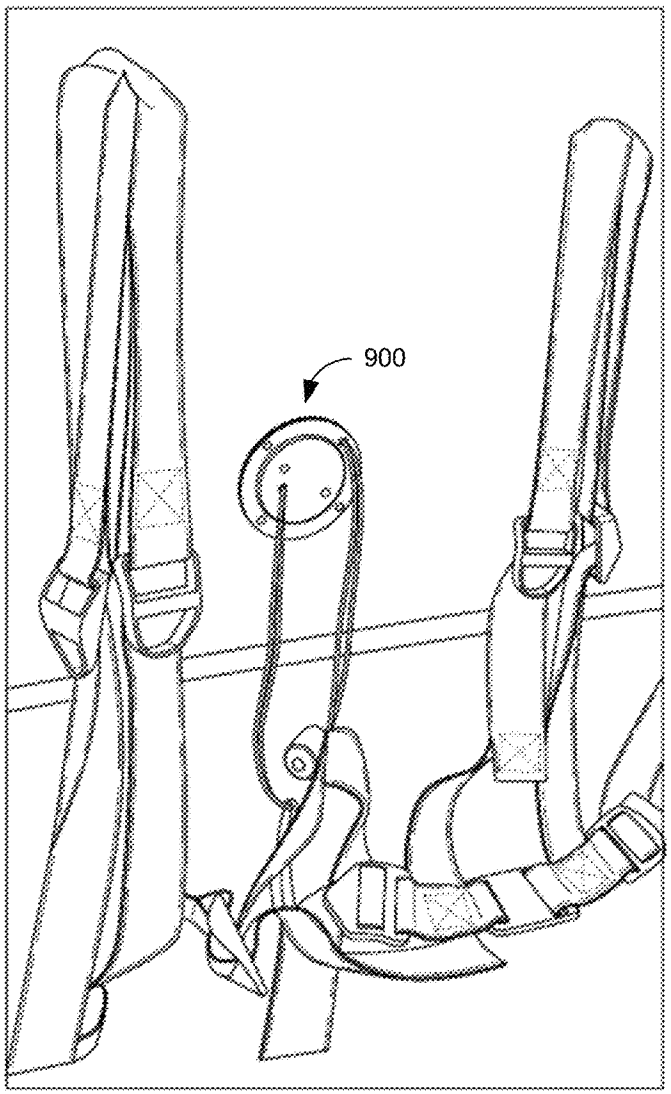
FIG. 9 is an interior view of a lifeboat bilge port.

FIG. 9 is an interior view of a lifeboat bilge port 900.

Figure 10:
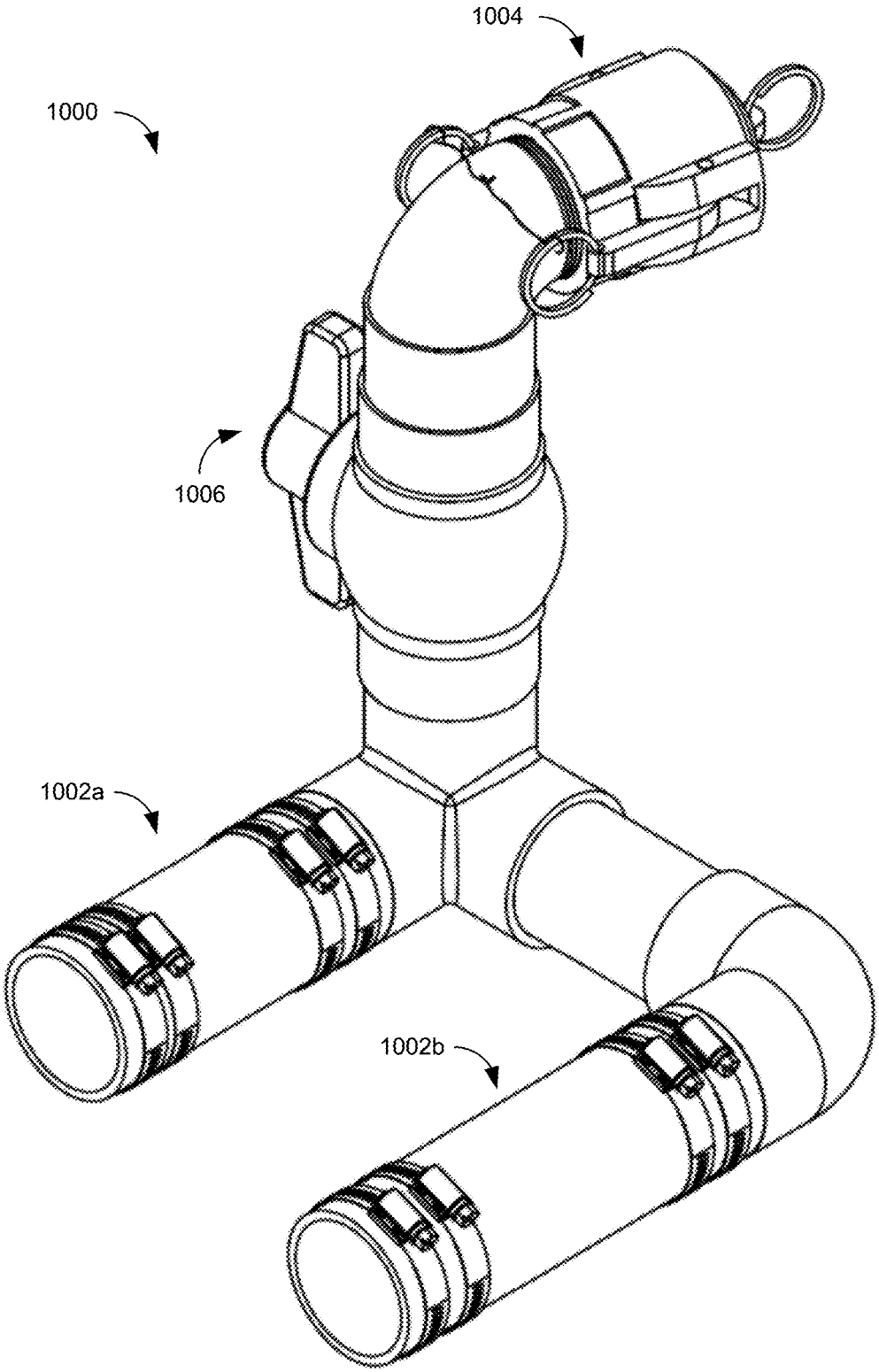
FIG. 10 is an isometric view of an engine cooling assembly for a CA5400/CA6000 lifeboat with a Bukhbeta BBV 2203 with hydraulic starter according some embodiments of the disclosed technologies.

FIG. 10 is an isometric view of an engine cooling assembly 1000 for a CA5400/CA6000 lifeboat with a Bukhbeta BBV 2203 with hydraulic starter according some embodiments of the disclosed technologies. Referring to FIG. 10, the engine cooling assembly 1000 may include hoses 1002*a,b* for connecting the assembly 1000 to the water cooling system of the lifeboat. The engine cooling assembly 1000 may include a can and groove assembly for connecting with a hose connected to a water container. The engine cooling assembly 1000 may include a water inlet valve 1006. The water inlet valve 1006 may be manually operated. The water inlet valve 1006 may be opened to admit water from the water container, and may be closed when water container is not connected.

Figure 11:
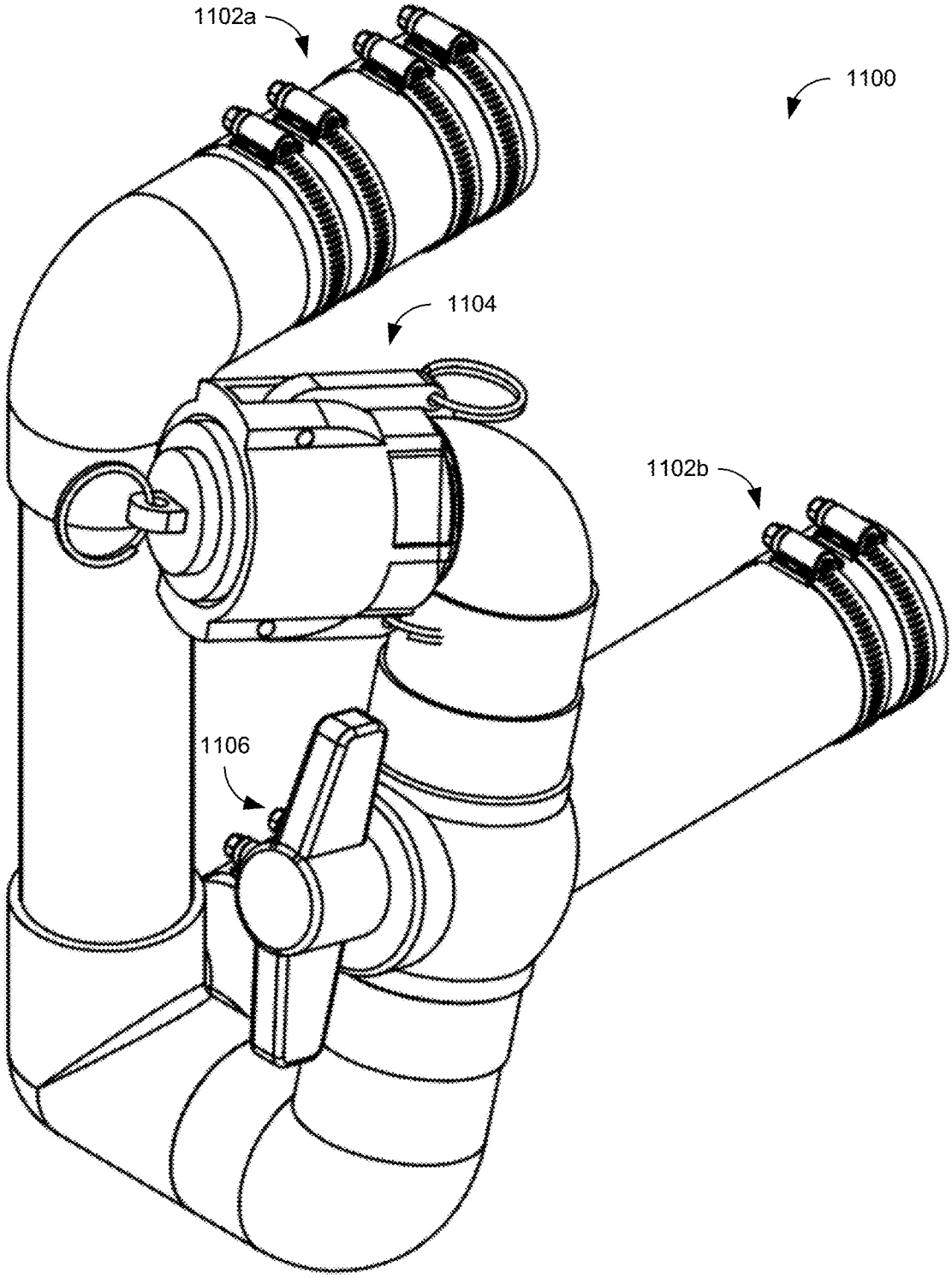
FIG. 11 is an isometric view of an engine cooling assembly for a CA5400/CA6000 lifeboat with a Bukhbeta BBV 2203 with hydraulic starter according some embodiments of the disclosed technologies.

FIG. 11 is an isometric view of an engine cooling assembly 1100 for a CA5400/CA6000 lifeboat with a Bukhbeta BBV 2203 with hydraulic starter according some embodiments of the disclosed technologies. Referring to FIG. 11, the engine cooling assembly 1100 may include hoses 1102*a,b* for connecting the assembly 1100 to the water cooling system of the lifeboat. The engine cooling assembly 1100 may include a can and groove assembly for connecting with a hose connected to a water container. The engine cooling assembly 1100 may include a water inlet valve 1106. The water inlet valve 1106 may be manually operated. The water inlet valve 1106 may be opened to admit water from the water container, and may be closed when water container is not connected.

Figure 12:
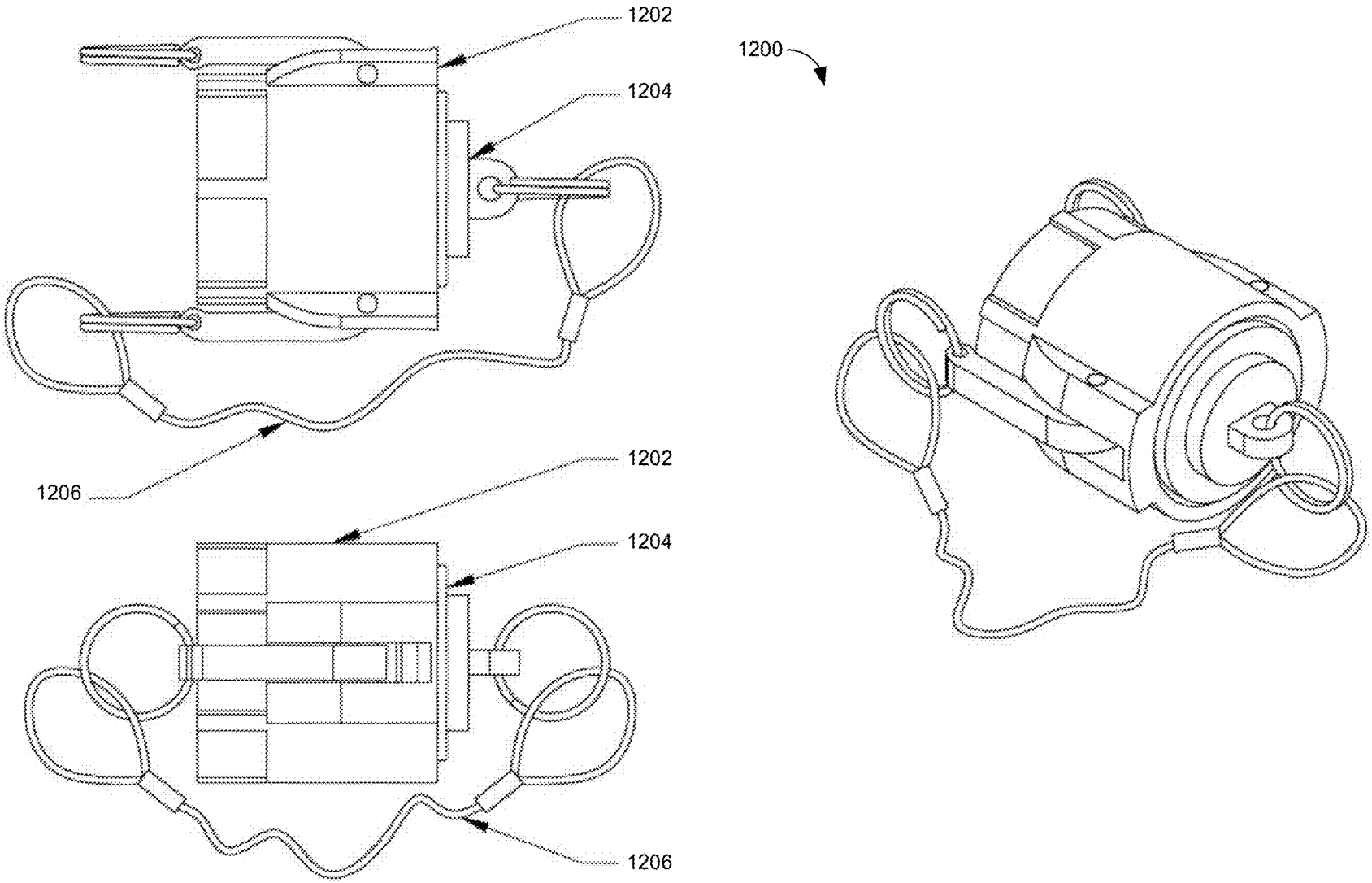
FIG. 12 includes views of a cam and groove assembly according to embodiments of the disclosed technologies.

FIG. 12 includes views of a cam and groove assembly 1200 according to embodiments of the disclosed technologies. The cam and groove assembly 1200 may include a cam and groove lock 1202, a cam and groove plug 1204, and a wire lanyard 1206. The cam and groove lock 1202 may be made of PVC, or the like. The cam and groove plug 1204 may be made of polypropylene, or the like. The wire lanyard 1206 may be used to secure the cam and groove plug 1204 to the cam and groove lock 1202, and may be made of steel wire, or the like.

Figure 13:
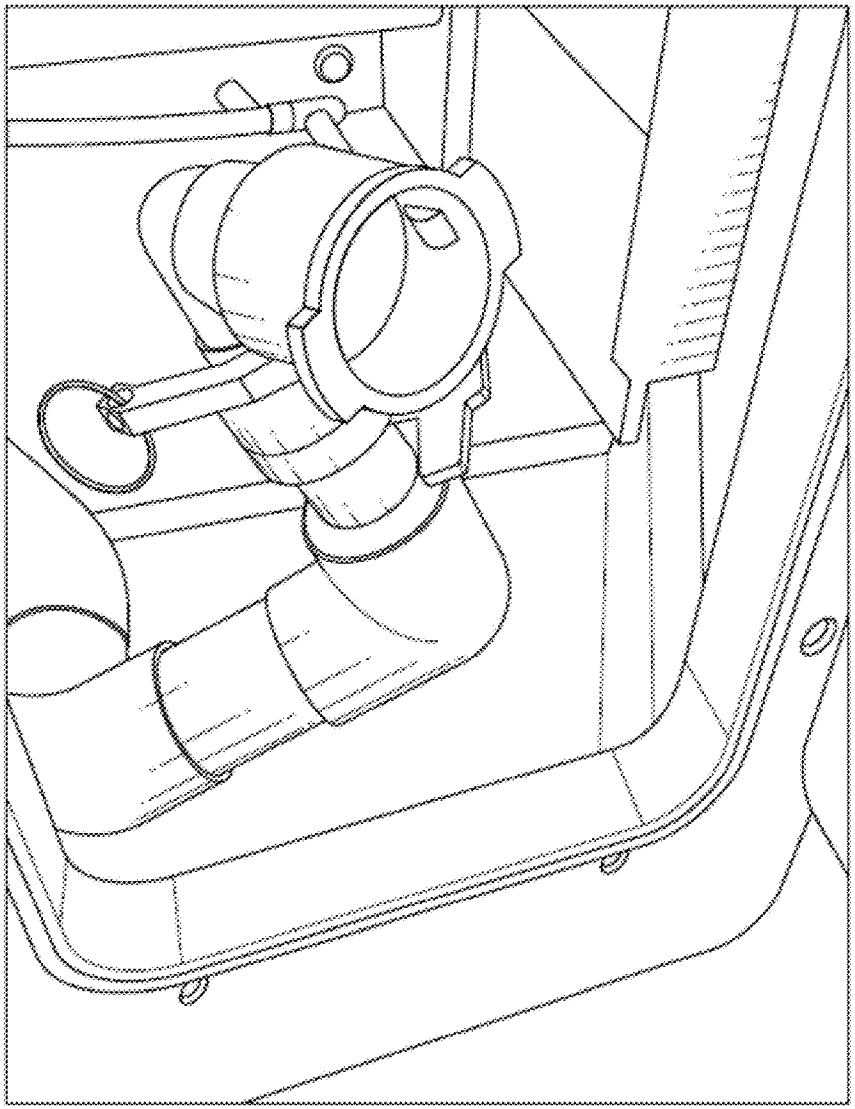
FIG. 13 illustrates an engine cooling assembly installed in a lifeboat according to some embodiments of the disclosed technologies.

FIG. 13 illustrates an engine cooling assembly installed in a lifeboat according to some embodiments of the disclosed technologies. In the photograph of FIG. 13, the cam and groove plug has been removed, and the cam and groove lock is ready for connection with a hose assembly.

Figure 14:
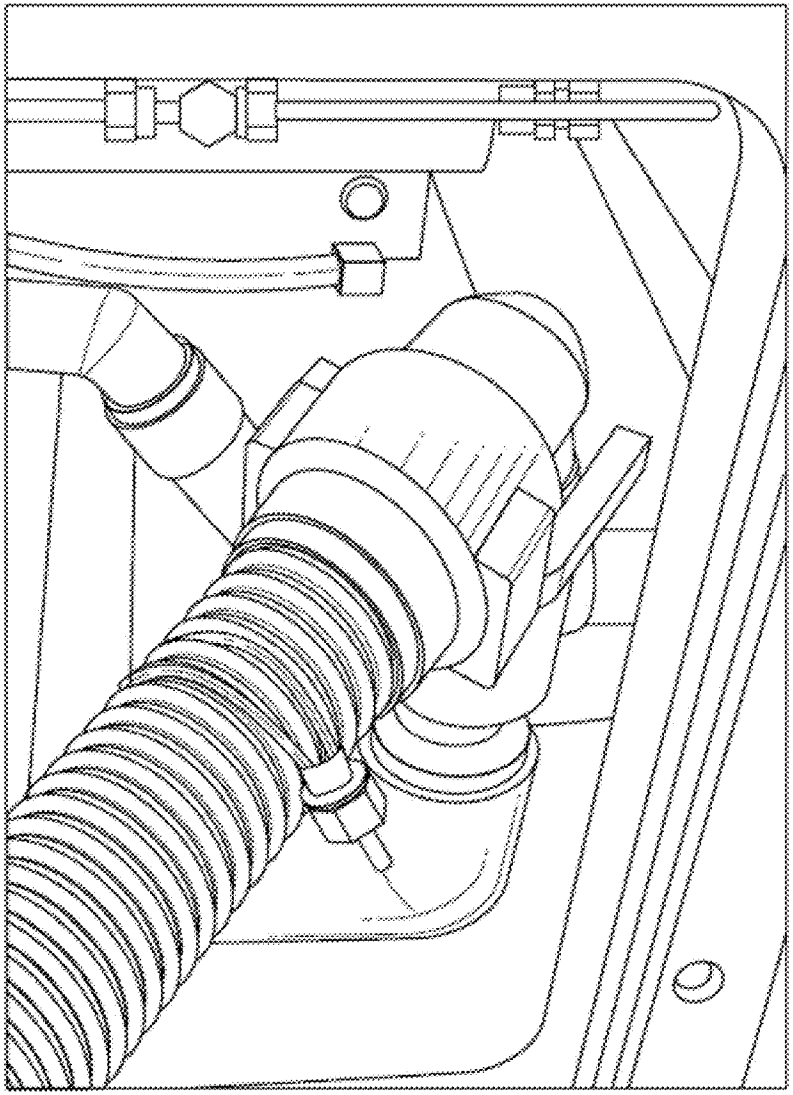
FIG. 14 illustrates the engine cooling assembly of FIG. 13 with the hose assembly connected.

FIG. 14 illustrates the engine cooling assembly of FIG. 13 with the hose assembly connected.

Figure 15:
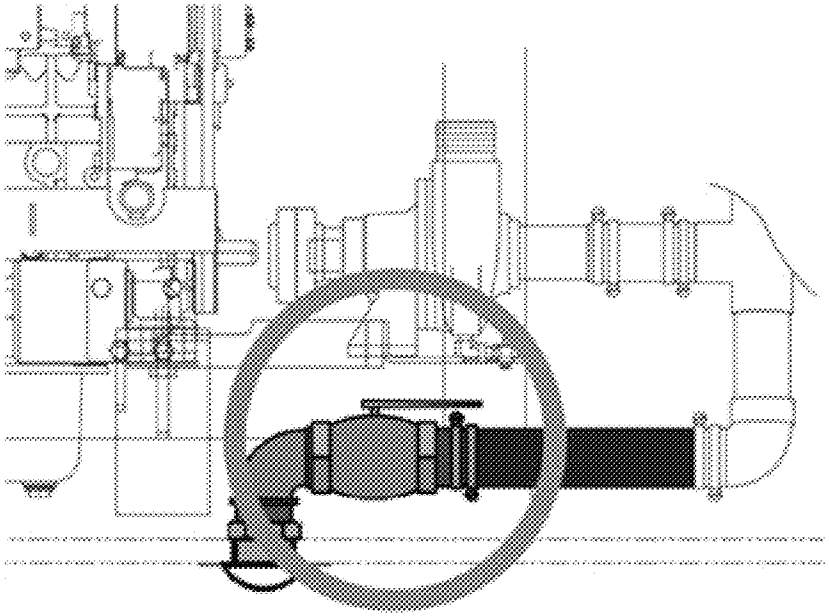
FIG. 15 is a schematic diagram of a seawater intake valve in the open position.

FIG. 15 is a schematic diagram of a seawater intake valve in the open position.

Figure 16:
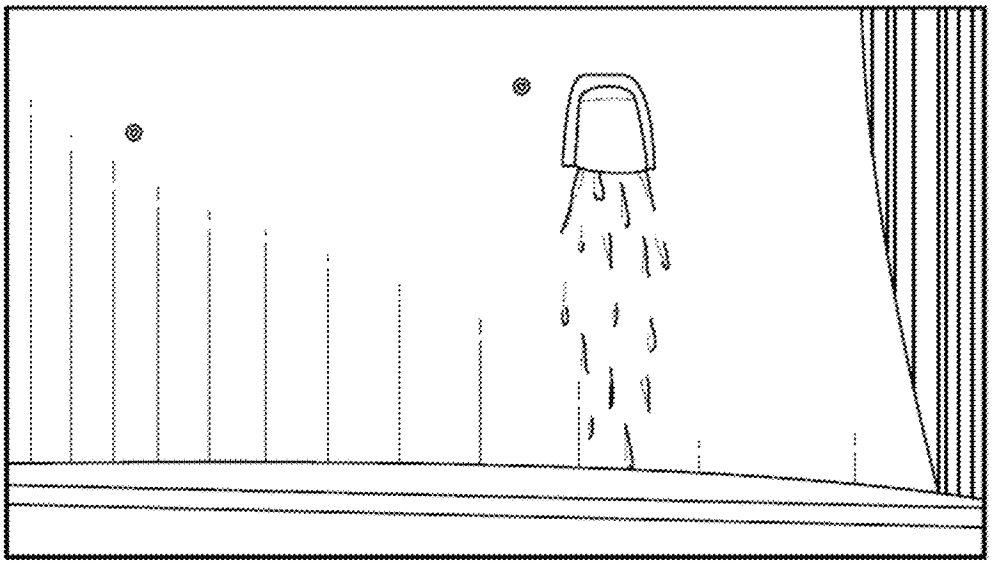
FIG. 16 illustrates a vent discharging water from a lifeboat after the water has passed through an engine heat exchanger of the lifeboat according to some embodiments of the disclosed technologies.

FIG. 16 illustrates a vent discharging water from a lifeboat after the water has passed through an engine heat exchanger of the lifeboat according to some embodiments of the disclosed technologies.

Figure 17:
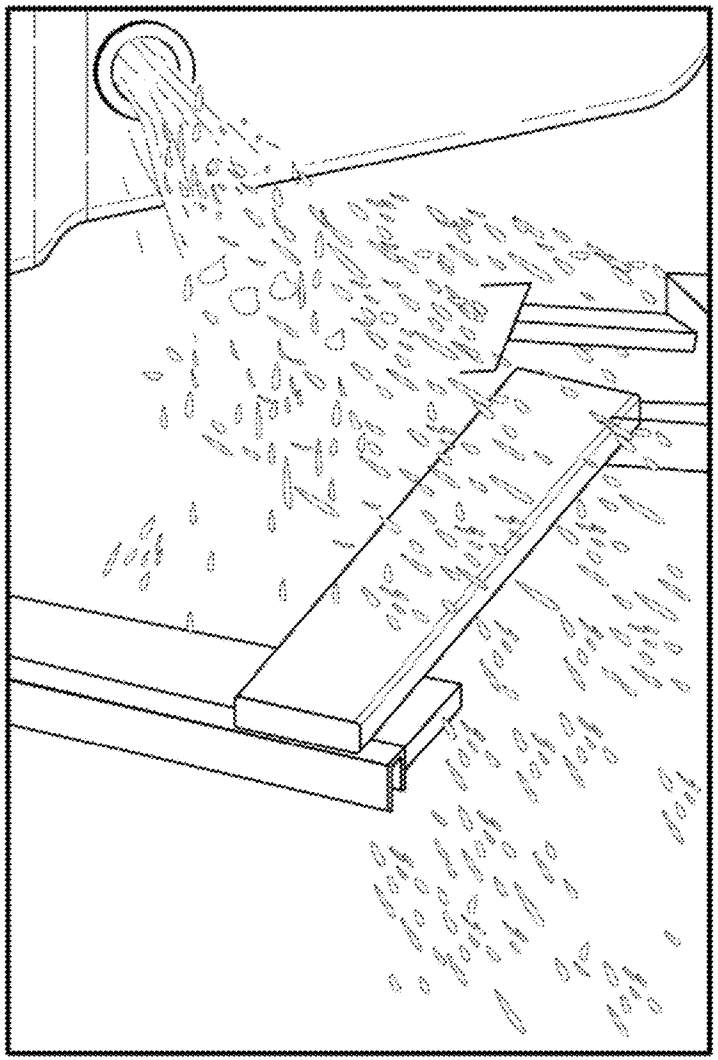
FIG. 17 illustrates an exhaust port discharging water from a lifeboat according to some embodiments of the disclosed technologies.

FIG. 17 illustrates an exhaust port discharging water from a lifeboat according to some embodiments of the disclosed technologies.

Figure 18:
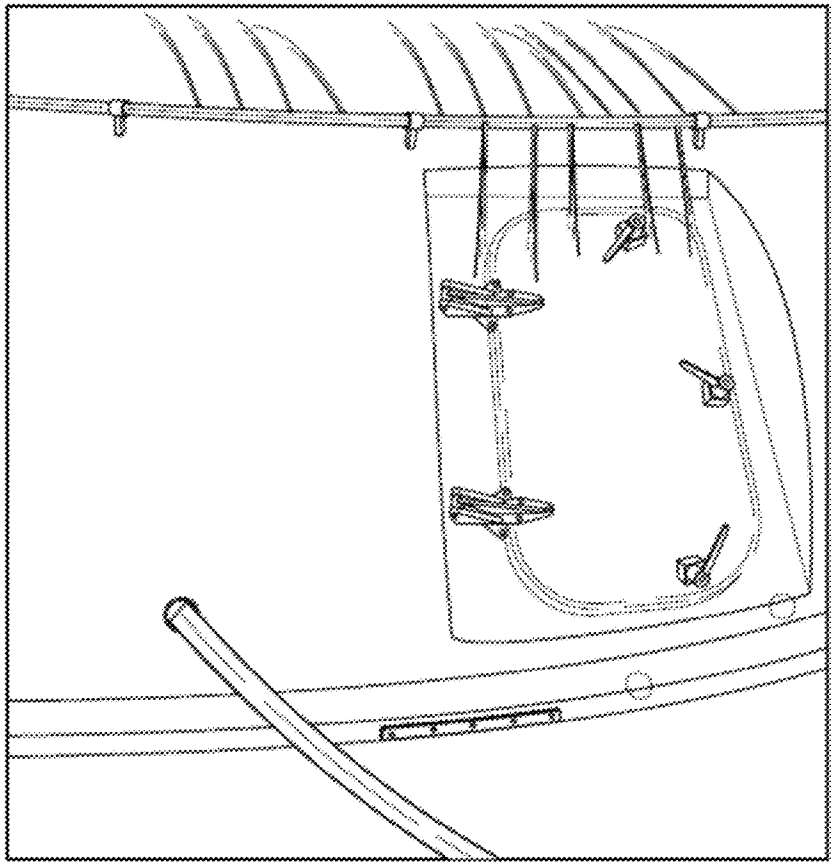
FIG. 18 illustrates a lifeboat sprinkler system discharging water onto the exterior all of the lifeboat according to some embodiments of the disclosed technologies.

FIG. 18 illustrates a lifeboat sprinkler system discharging water onto the exterior all of the lifeboat according to some embodiments of the disclosed technologies. Also visible in the photograph of FIG. 19 is a hose assembly of an in-davit run kit passing into the interior of the lifeboat through a bilge port to supply the water for the sprinkler system.

Figure 19:
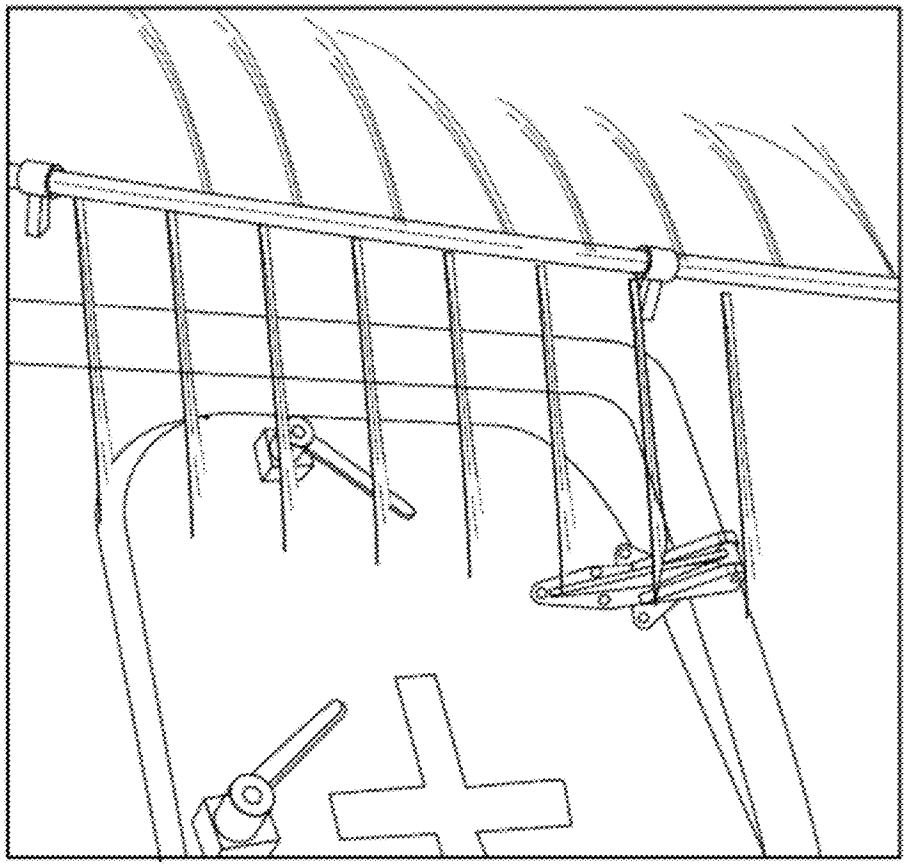
FIG. 19 is another photograph of a lifeboat sprinkler system discharging water onto the exterior all of the lifeboat according to some embodiments of the disclosed technologies.

FIG. 19 is another photograph of a lifeboat sprinkler system discharging water onto the exterior of a lifeboat according to some embodiments of the disclosed technologies.

Figure 20:
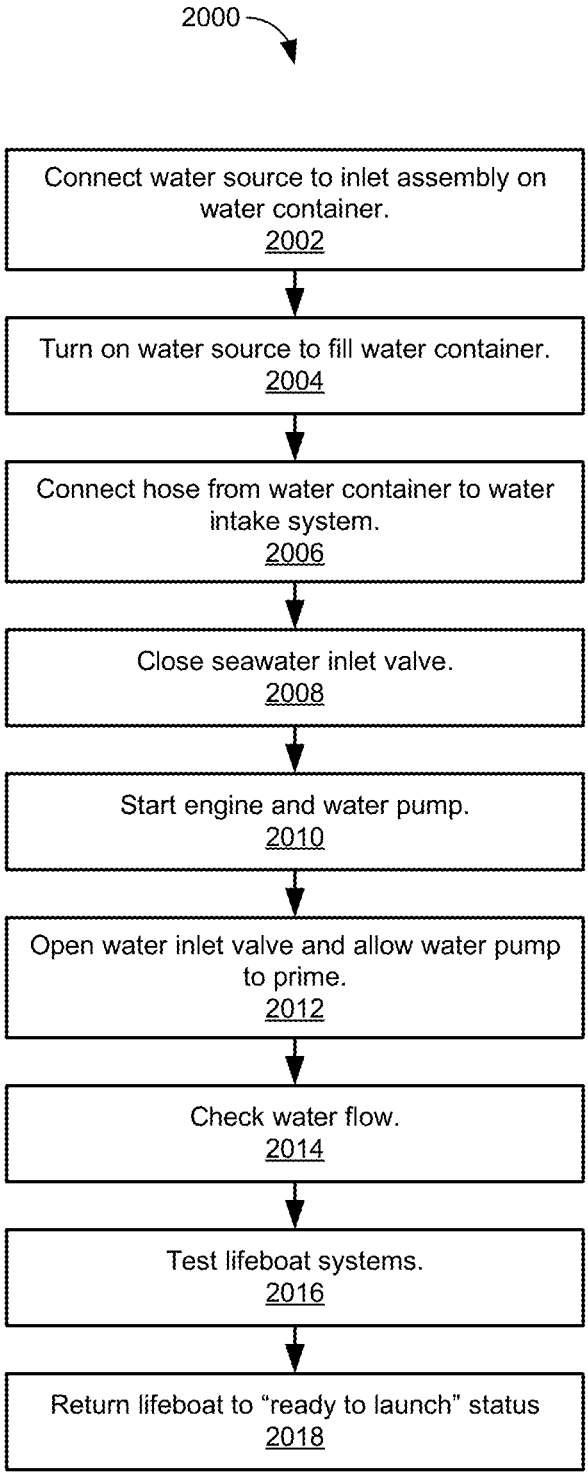
FIG. 20 is a flowchart illustrating a process for connecting and operating the disclosed in davit run kit according to some embodiments of the disclosed technologies.

FIG. 20 is a flowchart illustrating a process 2100 for connecting and operating the disclosed in davit run kit according to some embodiments of the disclosed technologies. The elements of the process 2000 are presented in one arrangement. However, it should be understood that one or more elements of the process may be performed in a different order, in parallel, omitted entirely, and the like. Furthermore, the process 2000 may include other elements in addition to those presented.

Referring to FIG. 20, the process 2000 may include connecting a water source to an inlet assembly on the water container, at 2002, and turning on the water source to fill the water container, at 2004. Referring again to FIG. 2, a hose may be connected to the inlet assembly 202 of the water container 200.

Referring again to FIG. 20, the process 2000 may include connecting a hose from the water container to the water intake system of the lifeboat, at 2006. For example, the hose assembly 500 of FIG. 5 may be used to connect the water container 200 of FIG. 2 to the water intake system of the lifeboat, for example as shown in FIGS. 7 and 14.

Referring again to FIG. 20, the process 2000 may include closing the seawater inlet valves of the lifeboat, at 2008. For example, referring again to FIG. 1, the seawater inlet valve 108 of the lifeboat 100 may be closed. As another example, the seawater intake valves of FIGS. 15 and 16 may be closed.

Referring again to FIG. 20, the process 2000 may include starting the engine and water pump, at 2010. For example, referring again to FIG. 1, an operator may start the engine 122 and the water pump 110 update lifeboat 100. The operator may follow standard operational procedures to start the engine. For example, the operator may turn the battery switch to the "on" position, and then start the engine from the helmsman's control panel.

Referring again to FIG. 20, the process 2000 may include opening the water inlet valve to allow the water pump to prime, at 2012. For example, referring again to FIG. 1, the water pump 110 may draw water from the water container 102 into the lifeboat 100 through the water inlet valve 104 and the check valve 106. The operator may rev up the engine to approximately 2,000 RPM to prime the water pump.

Referring again to FIG. 20, the process 2000 may include checking the water flow, at 2014. For example, referring again to FIG. 1, an operator may observe the exhaust vents 116, 130 of the lifeboat 100 to check for water discharge. The water pump is fully primed when there is a steady flow of water from the exhaust vents, as depicted in the photographs of FIGS. 17 and 18. If no water is seen within the first five minutes of operation, the engine may be shut down to prevent overheating.

Referring again to FIG. 20, the process 2000 may include testing the lifeboat systems, at 2016. For example, the testing may include testing the general start and operation of the lifeboat, the function of the engine and transmission of the lifeboat, a sprinkler system of the lifeboat, propeller and steering operations of the lifeboat, a water-cooled exhaust system of the lifeboat, and the like. During the testing, the operator may continuously replenish the water container, for example ensuring the water container is always failed to at least 50 percent of its capacity.

Once testing is complete, the process 2000 may include returning the lifeboat to "ready to launch" status, at 2018. For example, the water hose may be disconnected from the water inlet valve of the lifeboat, the water inlet valve may be closed, the seawater inlet valve may be opened, the bilge port may be closed, and the like.

With the disclosed in-davit kits installed and in operation, lifeboats can remain in the stowed position in the davits while the lifeboat is operated and tested for an extended time. As long as there is water in the portable water container, the lifeboat can run as long as needed. Without the disclosed in-davit kits, a lifeboat can operate in the davit for only a short period of time (approximately 5-10 minutes) before the engine overheats. And because the lifeboat need not be launched for testing, it is likely more testing and maintenance operations will be performed, thereby increasing the availability of the lifeboat in a time of need.

What is claimed is:

1. An in-davit run kit for a lifeboat, the kit comprising:

a water container comprising a first connector and an inlet assembly configured to receive a first hose for filling the water container, the inlet assembly comprising a vent configured to allow excess water to escape the water container;

a second hose configured to connect with the first connector; and a second connector configured to connect to the second hose, wherein the second connector is in fluid communication with a water cooling system of the lifeboat;

wherein the in-davit run kit allows a water pump of the lifeboat to draw water from the water container into the water cooling system of the lifeboat.

2. The kit of claim 1, further comprising:

a valve disposed between the second connector and the water cooling system of the lifeboat.

3. The kit of claim 1, further comprising:

a heat exchanger in fluid communication with an engine of the lifeboat, and in thermal communication with the water cooling system of the lifeboat.

4. The kit of claim 1, further comprising:

a propeller shaft bearing in fluid communication with the water cooling system of the lifeboat.

5. The kit of claim 1, further comprising:

a valve disposed between the water container and the first connector.

6. A lifeboat comprising:

a water cooling system;

a water container comprising a first connector and an inlet assembly configured to receive a first hose for filling the water container, the inlet assembly comprising a vent configured to allow excess water to escape the water container;

a connector configured to connect to a second hose, wherein the connector is in fluid communication with the water cooling system of the lifeboat; and a water pump configured to draw water through the second hose into the water cooling system of the lifeboat.

7. The lifeboat of claim 6, further comprising:

a valve disposed between the first connector and the water cooling system of the lifeboat.

8. The lifeboat of claim 6, further comprising:

an engine; and a heat exchanger in fluid communication with the engine of the lifeboat, and in thermal communication with the water cooling system of the lifeboat.

9. The lifeboat of claim 6, further comprising:

a propeller shaft bearing in fluid communication with the water cooling system of the lifeboat.

10. The lifeboat of claim 6, further comprising:

a sprinkler system in fluid communication with the water cooling system of the lifeboat.

11. The lifeboat of claim 10, further comprising:

a valve disposed between the sprinkler system and the water cooling system of the lifeboat.

12. A method comprising:

connecting a water container to a water cooling system of a lifeboat;

adding water to the water container through an inlet assembly of the water container;

starting an engine, and a water pump, of the lifeboat, wherein the water pump draws water from the water container into the water cooling system of the lifeboat; and discharging excess water through a vent of the inlet assembly.

13. The method of claim 12, further comprising:

opening a valve disposed between the water container and the water cooling system of the lifeboat.

14. The method of claim 12, further comprising:

closing a seawater intake valve of the water cooling system of the lifeboat prior to starting the engine and the water pump of the lifeboat.

15. The method of claim 12, further comprising, after starting the engine and the water pump, testing at least one of:

general start and operation of the lifeboat;

function of the engine of the lifeboat and a transmission of the lifeboat;

a sprinkler system of the lifeboat;

propeller and steering operations of the lifeboat; or a water-cooled exhaust system of the lifeboat.

* * * * *